US008057265B2

(12) United States Patent
Youssefi-Shams et al.

(10) Patent No.: US 8,057,265 B2
(45) **Date of Patent: *Nov. 15, 2011**

(54) ELECTRICAL CHARGER

(75) Inventors: Kasra Youssefi-Shams, Waterloo (CA); Felipe Oliveira Simoes, Waterloo (CA); Leonardo Aldana, Waterloo (CA)

(73) Assignee: Research In Motion Limited, Waterloo, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/639,074

(22) Filed: Dec. 16, 2009

(65) Prior Publication Data

US 2011/0009004 A1 Jan. 13, 2011

Related U.S. Application Data

(60) Provisional application No. 61/224,665, filed on Jul. 10, 2009.

(51) Int. Cl.
*H01R 25/00* (2006.01)

(52) U.S. Cl. ..... 439/655

(58) Field of Classification Search ..... 439/651, 439/655; 200/51.02, 51.12

See application file for complete search history.

(56) References Cited

U.S. PATENT DOCUMENTS 2,137,569 A * 11/1938 Friedman ..... 200/51.02
2,480,787 A * 8/1949 Stephan ..... 200/51 LM (Continued)

FOREIGN PATENT DOCUMENTS

DE 19542936 C1 10/1996

(Continued)

OTHER PUBLICATIONS

European Patent Office, "Extended European Search Report", dated Mar. 12, 2010.

*Primary Examiner* — Phuong Dinh
(74) *Attorney, Agent, or Firm* — Norton Rose OR LLP

(57) ABSTRACT

There is provided an electrical charger including a base unit and an adaptor unit. The base unit is configured for being coupled to an electronic device. The adaptor unit is configured for being coupled to a power supply. The base unit is configured to co-operate with the adaptor unit such that there is provided an electrically coupled state wherein the base unit is electrically coupled to the adaptor unit, and such that there is also provided an electrically uncoupled state wherein the base unit is electrically uncoupled from the adaptor unit. Effecting a change in state from one of the electrically coupled state or the electrically uncoupled state to the other one of the electrically coupled state and the electrically uncoupled state includes effecting rotation of the base unit relative to the adaptor unit. There is also provided an electrical charger including a base unit and an adaptor unit. The base unit is configured for being electrically coupled to an electronic device. The adaptor unit is configured for being electrically coupled to a power supply. The base unit is configured to co-operate with the adaptor unit so as to effect electrical coupling between the base unit and the adaptor unit. The base unit is configured to co-operate with the adaptor unit such that there is provided a mechanically coupled state wherein the base unit is disposed in a mechanical coupling relationship with the adaptor unit. Effecting mechanical uncoupling of the base unit from the adaptor unit includes effecting rotation of the base unit relative to the adaptor unit.

9 Claims, 11 Drawing Sheets

U.S. PATENT DOCUMENTS

| | | | | |
|---|---|---|---|---|
| 3,034,000 | A * | 5/1962 | Sanford | 307/156 |
| 4,386,333 | A | 5/1983 | Dillan | |
| 5,474,464 | A | 12/1995 | Drewnicki | |
| 5,613,863 | A | 3/1997 | Klaus et al. | |
| 5,634,806 | A | 6/1997 | Hahn | |
| 5,660,554 | A | 8/1997 | Mead | |
| 5,684,689 | A | 11/1997 | Hahn | |
| 5,791,921 | A | 8/1998 | Lee | |
| 5,934,921 | A | 8/1999 | Doong | |
| 6,039,608 | A | 3/2000 | Amero, Jr. et al. | |
| 6,086,395 | A | 7/2000 | Lloyd et al. | |
| 6,109,977 | A | 8/2000 | Baxter et al. | |
| 6,328,581 | B1 | 12/2001 | Lee et al. | |
| 6,669,495 | B2 | 12/2003 | Philips et al. | |
| 6,923,667 | B1 | 8/2005 | Chen | |
| 7,168,969 | B1 | 1/2007 | Wang | |
| 7,249,976 | B1 * | 7/2007 | Watson | 439/651 |
| 7,273,384 | B1 | 9/2007 | So | |
| 7,439,709 | B2 | 10/2008 | Bumiller | |
| 7,632,119 | B1 | 12/2009 | Ma et al. | |
| 2009/0117765 | A1 | 5/2009 | Wen et al. | |
| 2009/0137156 | A1 | 5/2009 | Simoes et al. | |
| 2011/0009003 | A1 | 1/2011 | Youssefi-Shams et al. | |
| 2011/0009005 | A1 | 1/2011 | Youssefi-Shams et al. | |

FOREIGN PATENT DOCUMENTS

| | | | |
|---|---|---|---|
| DE | 20 2006 011 804 | U1 | 11/2006 |
| DE | 202006014597 | U1 | 12/2006 |
| WO | 2005112204 | A1 | 11/2005 |
| WO | 2006070326 | A1 | 7/2006 |

* cited by examiner

Fig.10
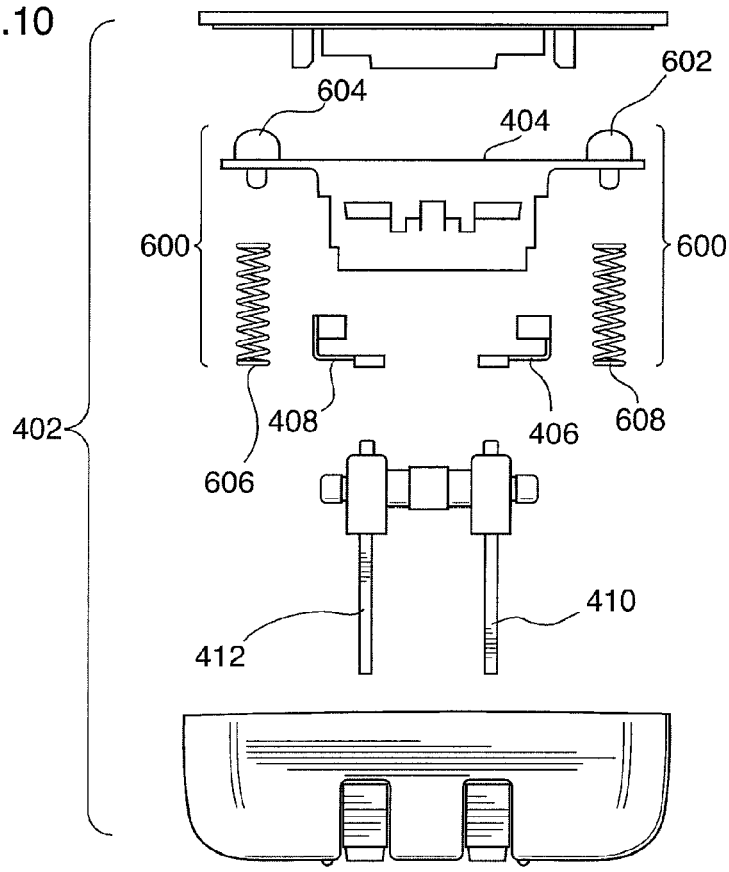
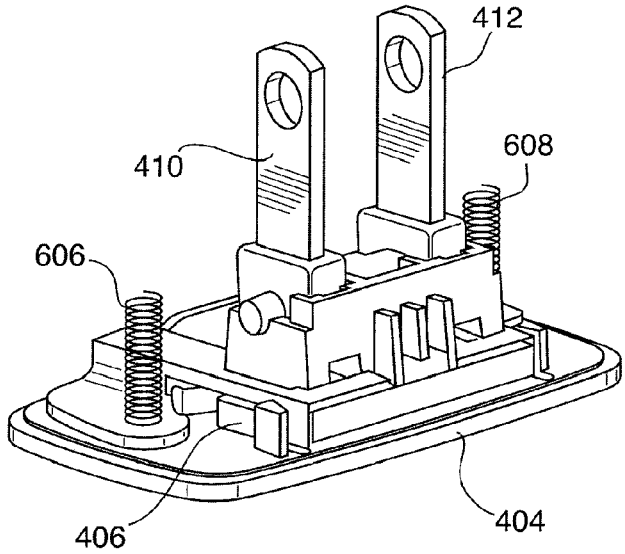
Fig.11

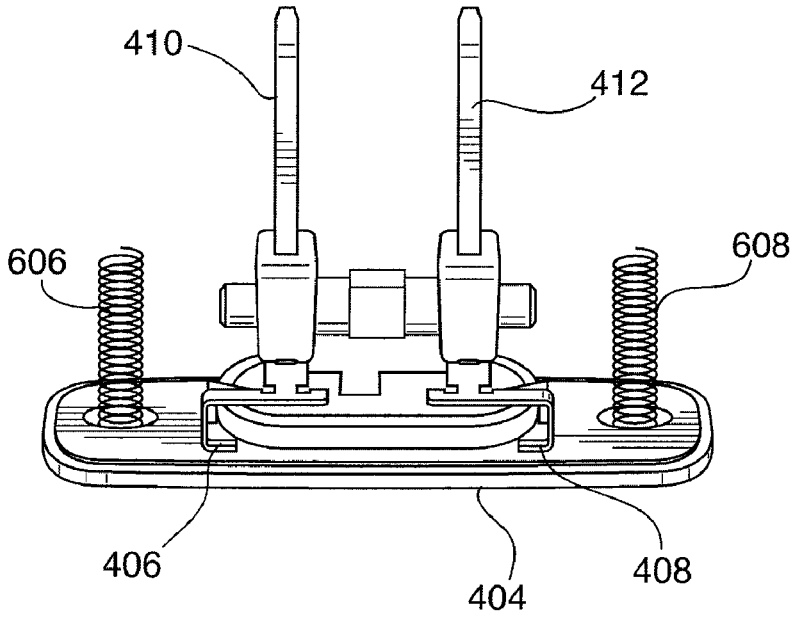
Fig.12
Fig.13
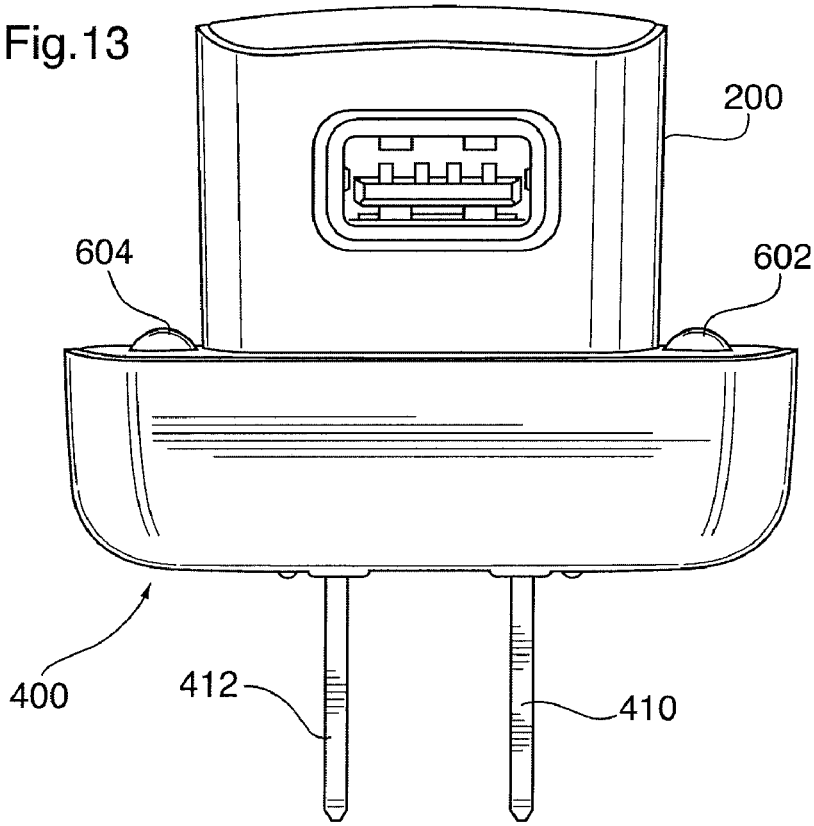

Fig.14
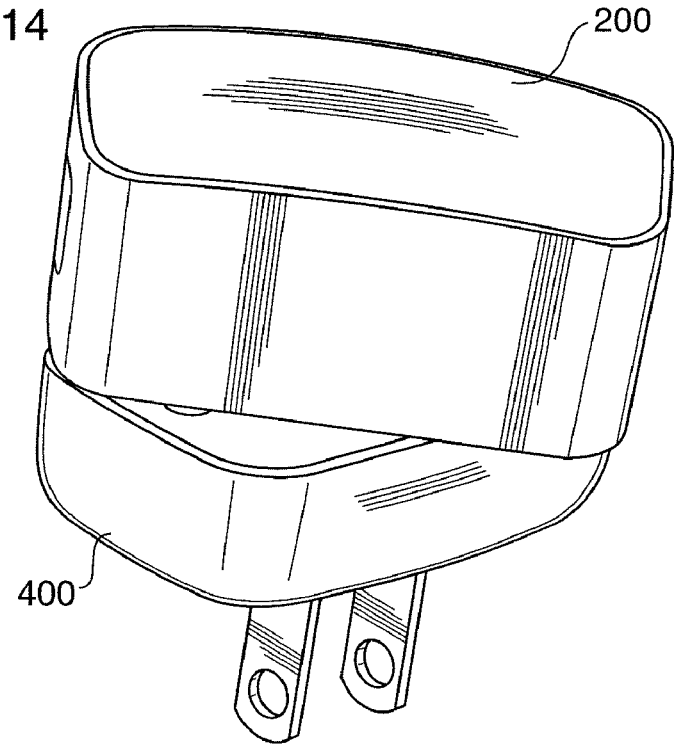
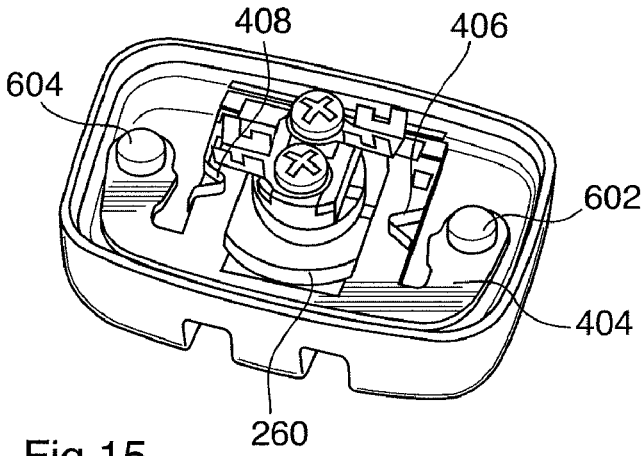
Fig.15

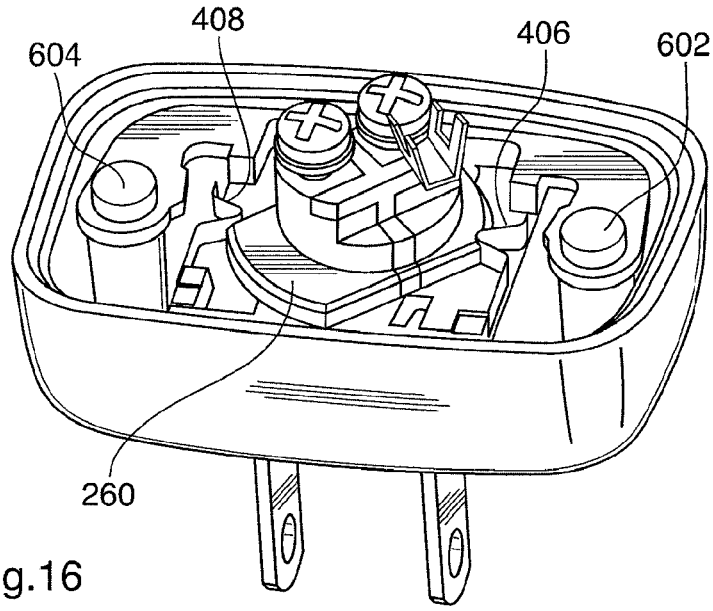
Fig.16
Fig.17
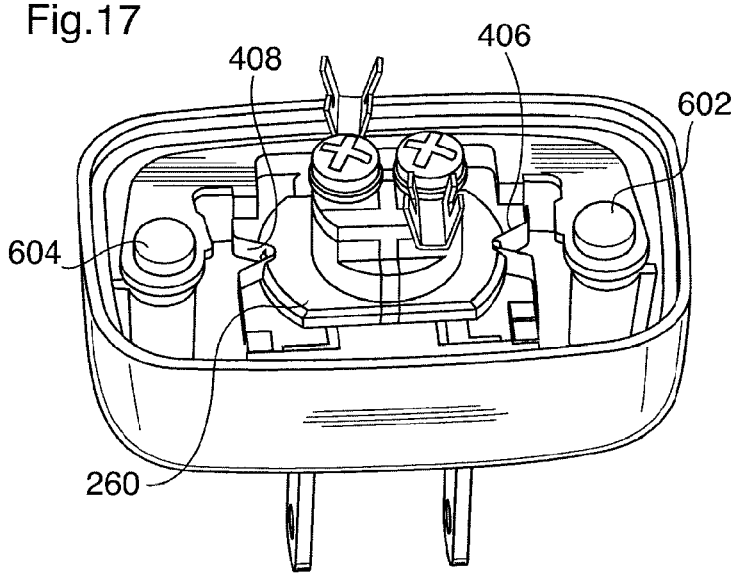

ELECTRICAL CHARGER

FIELD OF THE APPLICATION

This relates to the field of electrical chargers.

BACKGROUND

Electrical chargers are provided for charging the battery of an electronic device and for providing power to an electronic device. Electrical chargers include interchangeable adaptors which are configured for coupling to a base unit, and which expand the utility of electrical chargers across jurisdictions whose electrical systems are not compatible with each other. However, the interface between adaptors and base units of existing electrical chargers is less than ideal from an ergonomic perspective.

BRIEF DESCRIPTION OF THE DRAWINGS

FIG. 10 is another exploded view of the adaptor unit illustrated in FIG. 8;

FIG. 11 is a perspective view of a sub-assembly of the adaptor unit illustrated in FIG. 8, the subassembly comprising the mounting plate, the electrical contacts, the connector prongs, and the locking assembly;

FIG. 12 is a side view of one side of a sub-assembly of the adaptor unit illustrated in FIG. 8, the subassembly comprising the mounting plate, the electrical contacts, the connector prongs, and the locking assembly;

FIG. 13 is a view of one side of the embodiment illustrated in FIG. 1, showing the electrical charger in an unlocked state and in an electrically uncoupled state;

FIG. 14 is a perspective view of the embodiment illustrated in FIG. 1, showing the electrical charger in an unlocked state and mechanically coupled/electrically uncoupled state and having the base unit rotated relative to the adaptor unit by about 45 degrees clockwise from the positioning shown in FIG. 13;

FIG. 15 is a fragmentary view of the embodiment illustrated in FIG. 1, showing the electrical connector plug of base unit in an inserted uncoupled state relative to the adaptor unit, with the base unit in an electrically uncoupled relationship relative to the adaptor unit;

FIG. 16 is another fragmentary view of the embodiment illustrated in FIG. 1, showing the electrical connector plug of base unit in a mechanically coupled state relative to the adaptor unit, with the base unit rotated relative to the adaptor unit by about 45 degrees clockwise from the positioning shown in FIG. 15, and with the base unit in an electrically coupled relationship with the adaptor unit, and with the base unit in an unlocked state relative to the adaptor unit;

FIG. 17 is another fragmentary view of the embodiment illustrated in FIG. 1, showing the plug of the base unit in a mechanically coupled state with the adaptor unit, an electrically coupled relationship with the adaptor unit, and in a locked state relative to the adaptor unit, wherein the base unit rotated relative to the adaptor unit by about 90 degrees clockwise/counter clockwise from the positioning shown in FIG. 15;

DETAILED DESCRIPTION OF PREFERRED EMBODIMENTS

Figure 1:
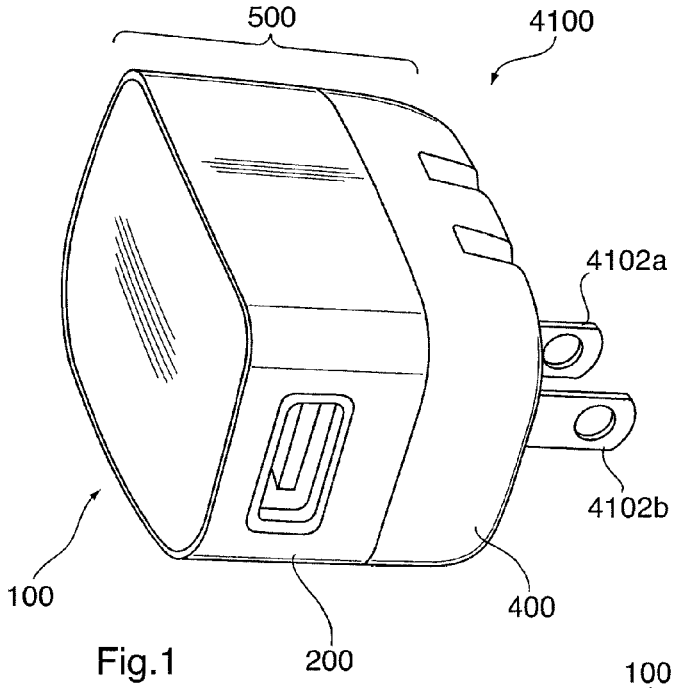
FIG. 1 is a perspective view of an embodiment of an electrical charger using a North American-type adaptor, showing the electrical charger in the locked state and in the electrically coupled state.
Figure 2:
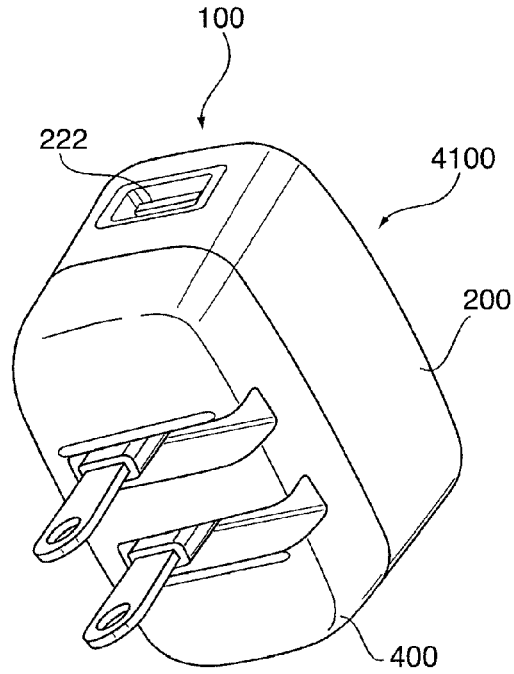
FIG. 2 is another perspective view of the embodiment illustrated in FIG. 1.
Figure 3:
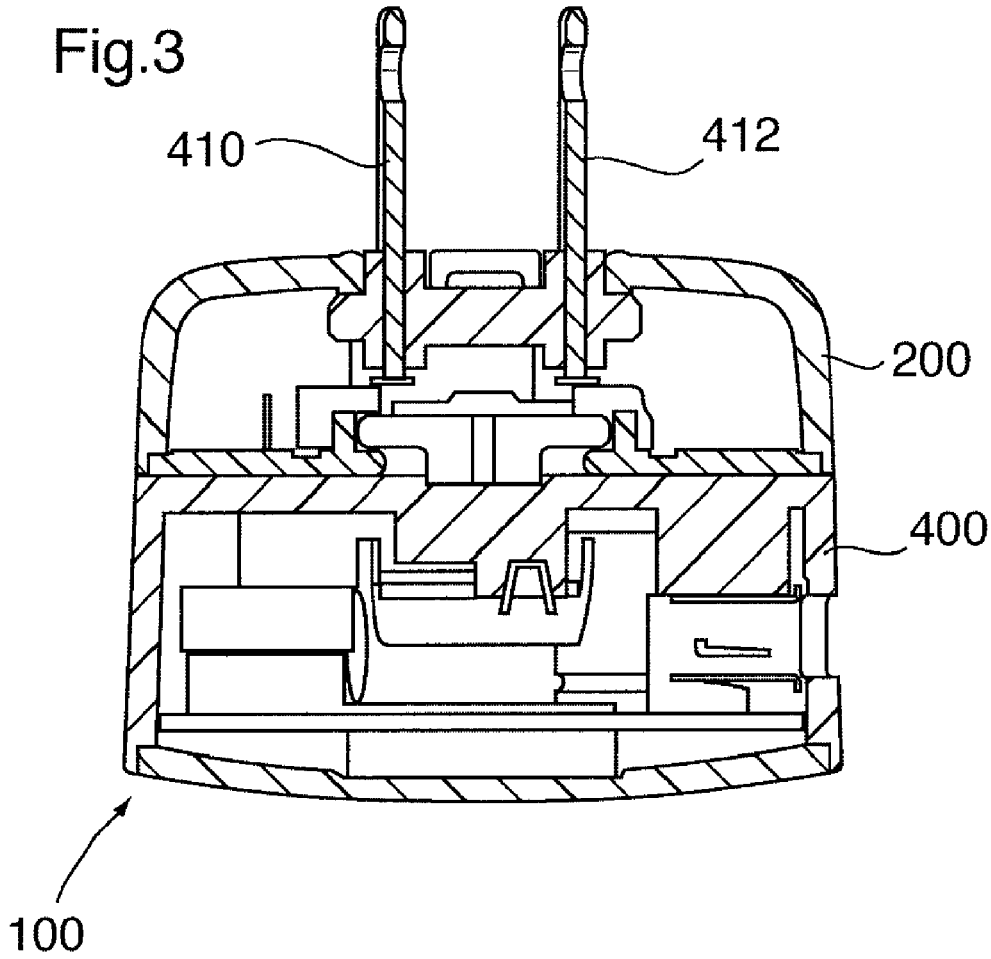
FIG. 3 is a front sectional elevation view of the embodiment illustrated in FIG. 1.

Referring to FIGS. 1, 2 and 3, there is provided an electrical charger 100 for charging the battery of an electronic device and/or providing power to an electronic device. The electrical charger 100 includes a base unit 200 and an adaptor unit 400. The base unit 200 and the adaptor unit 400 are co-operatively configured so as to effect electrically coupling therebetween. The base unit 200 is configured for being coupled to an electronic device. In some embodiments, the base unit 200 and the adaptor unit 400 are co-operatively configured to effect mounting to one another.

In some embodiments, the charger system includes a universal power transformer for producing a regulated output voltage to an electronic device when the electronic device is coupled to the base unit 200. The power transformer includes a power converter circuit. For example, the power converter circuit converts an AC power supply, to which the converter circuit is coupled via the adaptor unit 400, to a DC power supply. In some embodiments, the power transformer is provided within the base unit 200.

Referring to FIGS. 4, 5, 6 and 7, in some embodiments, the base unit 200 includes a housing 210, a printed circuit board ("PCB") assembly 220, and an electrical contact assembly 230. The electrical contact assembly 230 includes contacts 262, 264. The electrical contact assembly 230 is mounted to the housing 210 with screws and configured for electrical coupling to the adaptor unit 400. The housing 210 includes a cavity defining portion 212 and a cover 214. The cover 214 is secured to the housing 210 by ultrasonic welding. The PCB assembly 220 is mounted within the housing 210 and electrically coupled to the electrical contact assembly 230 through a crimp/wire terminal assembly. The PCB assembly 220 includes a USB connector 222 for facilitating electrical coupling with an electronic device. A foam pad 240 is provided to compensate for component dimensional variances. An insulator sheet 250 is provided to effect dielectric separation between the screws/crimps and high voltage caps.

The adaptor unit 400 is configured for electrical coupling to a power supply. In this respect, by being configured to be electrically coupled to the base unit 200, the adaptor unit 400 is also configured to effect electrical coupling between the base unit 200 and a power supply.

In some embodiments, the adaptor unit 400 is in the form of a removable and replaceable adaptor unit 4000, such as any one of adaptor units 4100, 4200, and 4300. Use of removable and replaceable adaptor units 4000 enable the electrical charger 100 to be used in different countries in connection with different electrical systems.

Figure 8:
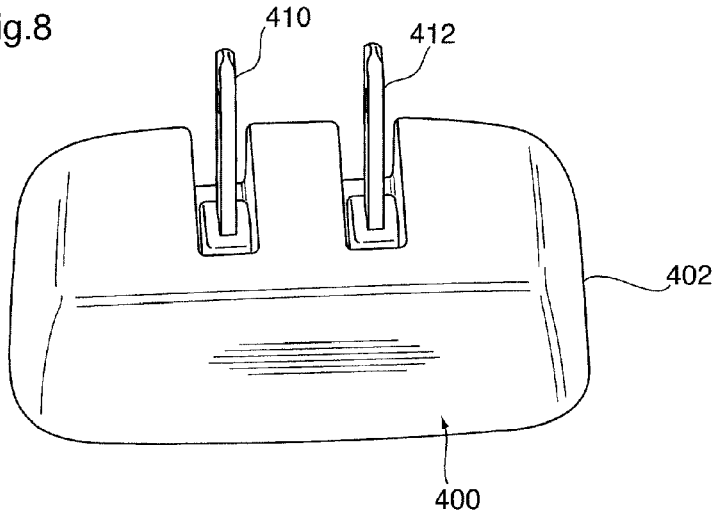
FIG. 8 is a perspective view of an adaptor unit of the embodiment illustrated in FIG. 1.
Figure 18:
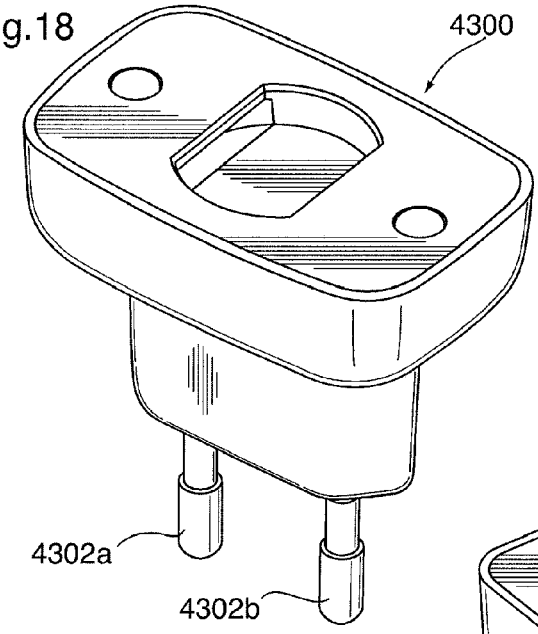
FIG. 18 is a perspective view of a European-type adaptor which is suitable for use with the base unit illustrated in FIG. 4 in another embodiment of the electrical charger.
Figure 19:
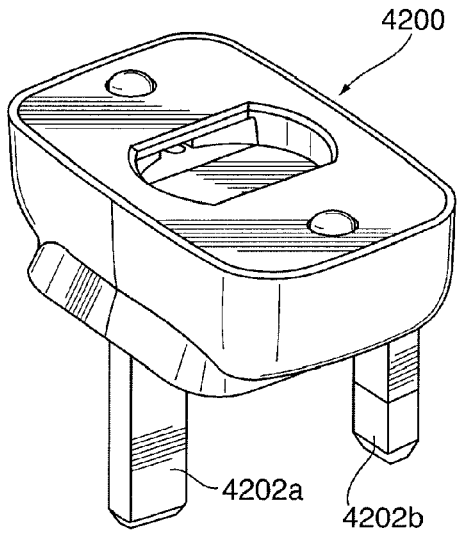
FIG. 19 is a perspective view of a United Kingdom-type adaptor which is suitable for use with the base unit illustrated in FIG. 4 in another embodiment of the electrical charger.

FIGS. 8, 18 and 19 illustrate exemplary adaptor plugs 4000 that are interchangeable and are configured for coupling to the base unit 200.

Figure 20:
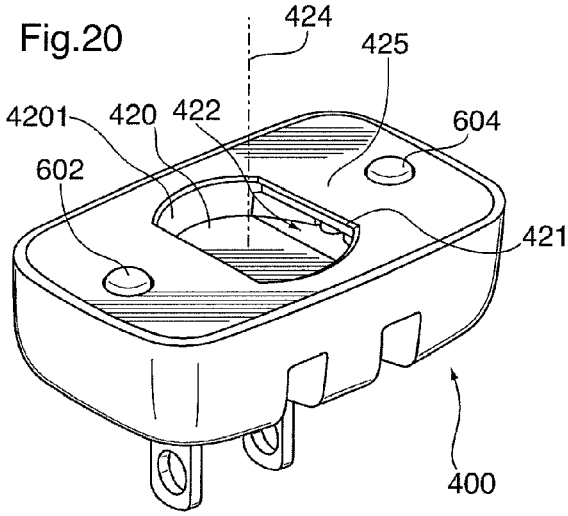
FIG. 20 is a perspective view of an adaptor unit of the embodiment illustrated in FIG. 1.

Referring to FIGS. 1, 2 and 20, the adaptor unit 4100, for example, is an adaptor unit suitable for use in connection with the standard 110 volt electrical system utilized in North America, and also for use with sockets configured to receive type N plugs. The adaptor unit 4100 includes connector prongs 4102*a*, 4102*b*.

Referring to FIG. 19, the adaptor unit 4200 includes wall socket prongs 4202*a* and 4202*b* for use in United Kingdom style wall sockets found in the United Kingdom and the like. It is also for use with wall sockets configured to receive type D plugs.

Referring to FIG. 18, the adaptor 4300 includes prongs 4302*a*, 4302*b* for use in European style wall sockets found in Europe.

The adaptor unit 4100, and other adaptor units suitable for use in other electrical systems, are configured for selective coupling to the base unit 200.

Figure 9:
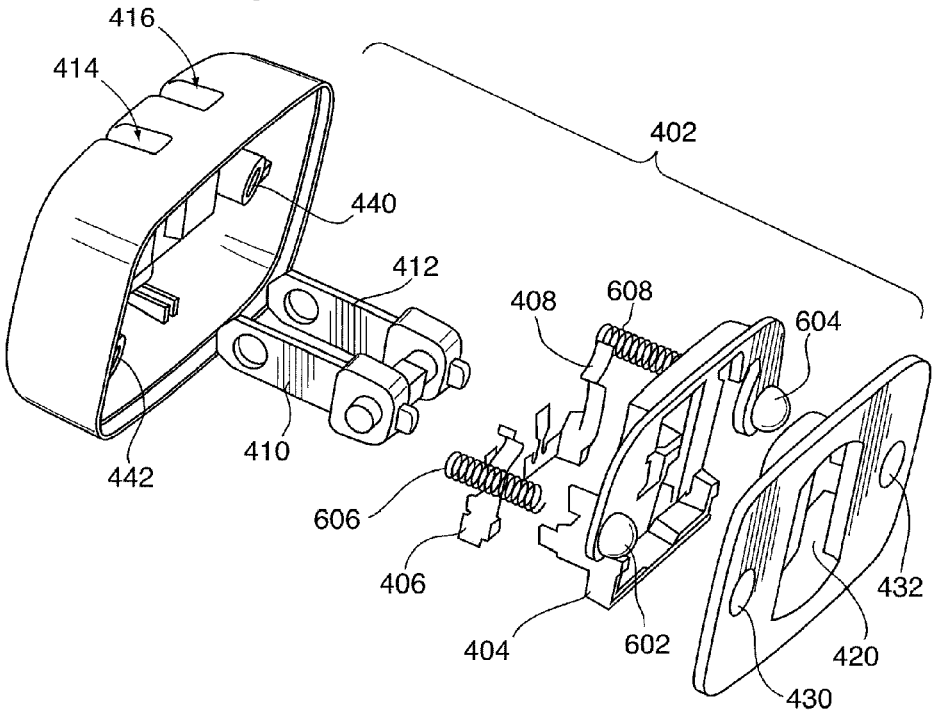
FIG. 9 is an exploded view of the adaptor unit illustrated in FIG. 8.

Referring to FIGS. 8, 9 and 10, in some embodiments, adaptor unit 400 includes a housing 402, a mounting plate 404, electrical contacts 406, 408, and connector prongs 410, 412. The mounting plate 404 is disposed within and coupled to the housing 402. The electrical contacts 406, 408 and the connector prongs 410, 412 are mounted to the mounting plate 404. In the embodiment illustrated in FIGS. 1, 2 and 20, which is an example of a North American-type adaptor unit 4100, the connector prongs 410, 412 are positionable relative to the housing 402 between an extended position and a retracted position. In the retracted position, the connector prongs 410, 412 are received within recesses 414, 416. In this respect, the connector prongs 410, 412 are rotatably mounted to the mounting plate 404. The electrical contacts 406, 408 are electro-mechanically connected to the connector prongs 410, 412 in the extended position. In some embodiments, the electrical contacts 406, 408 are electro-mechanically connected to the connector prongs in both extended and retracted positions.

Figure 21:
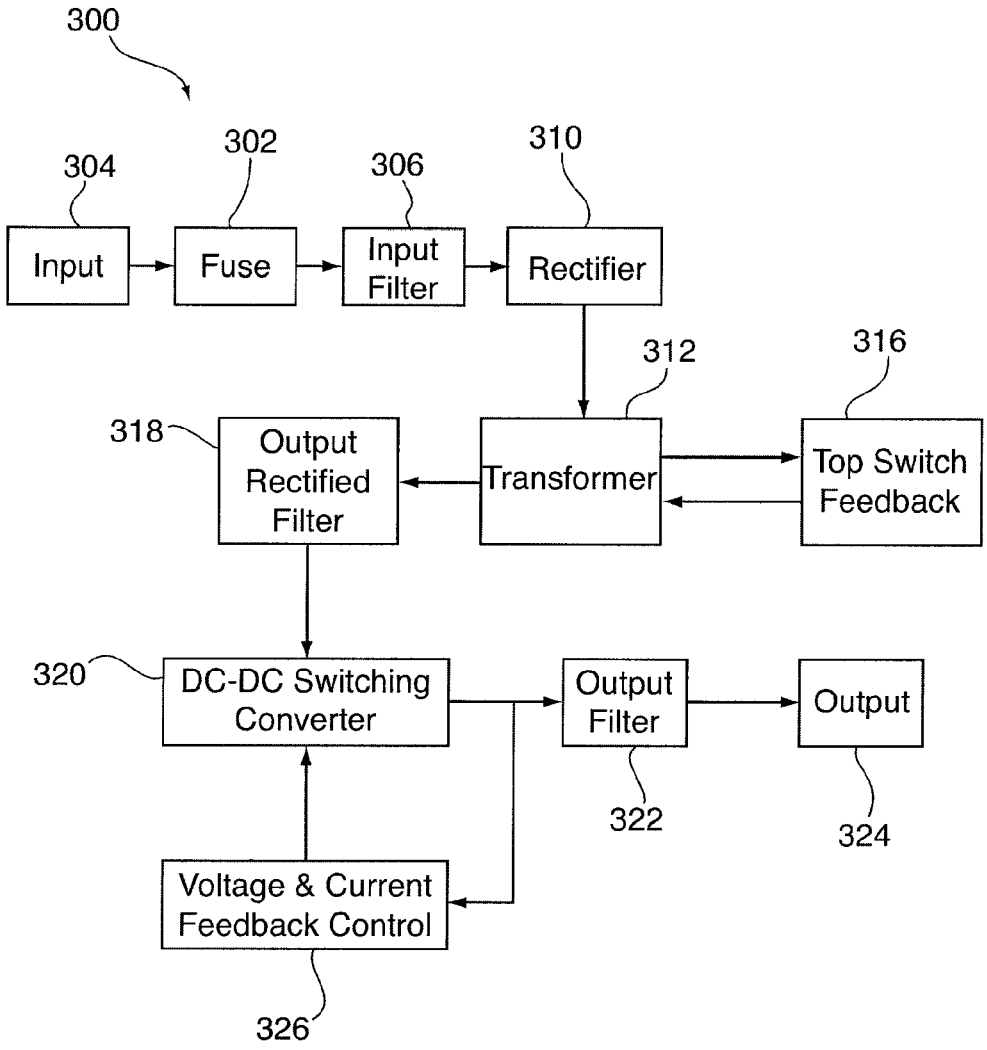
FIG. 21 is a block diagram of an electronic system of the embodiment illustrated in FIG. 1.

FIG. 21 illustrates an electrical block diagram 300 of some embodiments of the electrical charger 100. A fuse 302 is situated between, and is in electrical communication with, an input voltage source 304 and an electrical filter 306. A rectifier 310 couples the electrical filter 306 to a direct current (DC) transformer 312. The DC transformer 312 couples a top switch feedback-loop 316 and an output-rectified filter 318. The output-rectified filter 318 couples to a DC-DC converter 320 which, in turn, couples to an output filter 322. The outlet filter 322 couples with an output 324. A voltage and current feedback controller 326 couples to the DC-DC converter 320 and the output filter 322.

In this respect, during operation of such embodiments, an alternating electrical current (AC) is supplied to the electrical charger 100 from an input source 304. For example, this is achieved by plugging the electrical charger 100 into a wall socket. The fuse 302 protects the electrical charger 100 from electrical surges from the input source 304. The filter 306 cleans the input electrical signal. The rectifier 310 converts the AC current signal to a substantially DC current signal. The signal is then converted from a high voltage low current signal to a lower voltage higher current signal by a DC transformer 312. The top switch feedback-loop 316 maintains the DC voltage output from the transformer 312 within a constant range of voltage. The output-rectified filter 318 separates any noise from the low voltage, high current DC signal that may have been generated by the DC transformer 312. The DC-DC converter 320 converts the low voltage, high current DC signal to a lower voltage signal. This lower voltage signal is passed through the output filter 322. The output filter 322 filters noise from the lower voltage signal and passes the lower voltage signal to the output 324. The voltage and current voltage feedback controller 326 maintains a constant current and regulates the output voltage.

The electrical output from the electrical charger 100 is used to recharge batteries or provide power in real time to an electronic device. Examples of such electronic devices include cellular phones, digital wireless phones, 1-way pager, 1½-way pagers, 2-way pagers, electronic mail appliances, internet appliances, personal digital assistants (PDA), laptop computers, and portable digital audio players.

Each one of the above-described embodiments includes at least one of the following features.

A. Feature Relating to Effecting Electrical Coupling of the Base Unit to Adaptor Unit by Rotation There is provided a feature relating to effecting the electrical coupling of the base unit 200 to the adaptor unit 400 by rotation.

In this respect, and referring to FIGS. 4, 8, 13 and 20, there is provided the base unit 200 and the adaptor unit 400. The base unit 200 is configured for being coupled to an electronic device. The adaptor unit 400 is configured for being coupled to a power supply. The base unit 200 is configured to co-operate with the adaptor unit 400 such that there is provided an electrically coupled state wherein the base unit 200 is electrically coupled to the adaptor unit 400, and such that there is also provided an electrically uncoupled state wherein the base unit 200 is electrically uncoupled from the adaptor unit 400. Effecting a change in state from one of the electrically coupled state or the electrically uncoupled state to the other one of the electrically coupled state and the electrically uncoupled state includes effecting rotation of the base unit 200 relative to the adaptor unit 400.

In some embodiments, and referring to FIGS. 4, 8, 9, 10, 11, 12 and 20, the base unit 200 includes an electrical connector plug 260. The electrical connector plug 260 includes a plurality of electrical connector plug contacts 262, 264. The adaptor unit 400 includes a plurality of adaptor unit contacts 406, 408. The adaptor unit 400 also includes a receiving aperture 421. The receiving aperture 421 is provided on an exterior surface 425 of the adaptor unit 400 and defines an opening for an electrical connector plug receiving aperture 420. The electrical connector plug receiving receptacle 420 extends from the receiving aperture 421 and is configured for receiving insertion of the electrical connector plug 260.

In some embodiments, after the electrical connector plug 260 is inserted within the electrical connector plug receiving receptacle 420 and while the electrical connector plug 260 is disposed within the electrical connector plug receiving receptacle 420, each one of the electrical connector plug contacts 262, 264 is disposable to an electrical contact engagement state with a respective one of the adaptor unit contacts 406, 408 such that, when the adaptor unit 400 becomes electrically coupled to a power supply and the base unit 200 becomes disposed in an electrical coupling relationship with an electronic device and each one of the electrical connector plug contacts 262, 264 becomes disposed in electrical contact engagement with a respective one of the adaptor unit contacts 406, 408, power is supplied to the electronic device. In some embodiments, the electrical connector plug receiving receptacle 420 includes a continuous sidewall 4201 extending from the aperture 421 for guiding the insertion of the electrical connector plug 260 into the electrical connector plug receiving aperture 421. Any plane tangent to the continuous sidewall 4201 includes a normal axis which is transverse to the axis of the aperture 421.

In some embodiments, each one of the adaptor unit contacts 406, 408 is disposed peripherally relative to the periphery of the aperture 421. In some embodiments, each one of the adaptor unit contacts is spaced apart from any line which is parallel to the axis of the receiving aperture and which is disposed within the perimeter of the receiving aperture. These features reduces the risk of inadvertent human contact with the contacts 406, 408.

Figure 5:
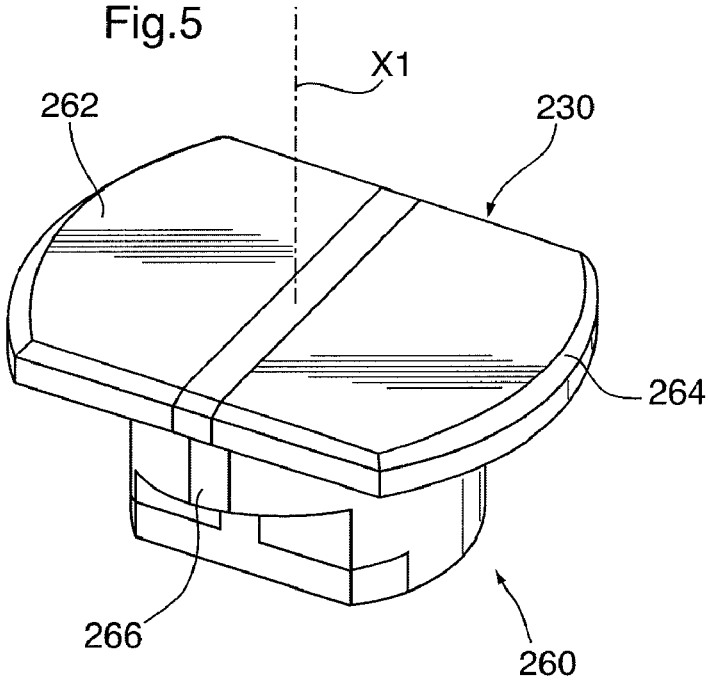
FIG. 5 is a perspective view of a connector plug of the base unit illustrated in FIG. 4.
Figure 6:
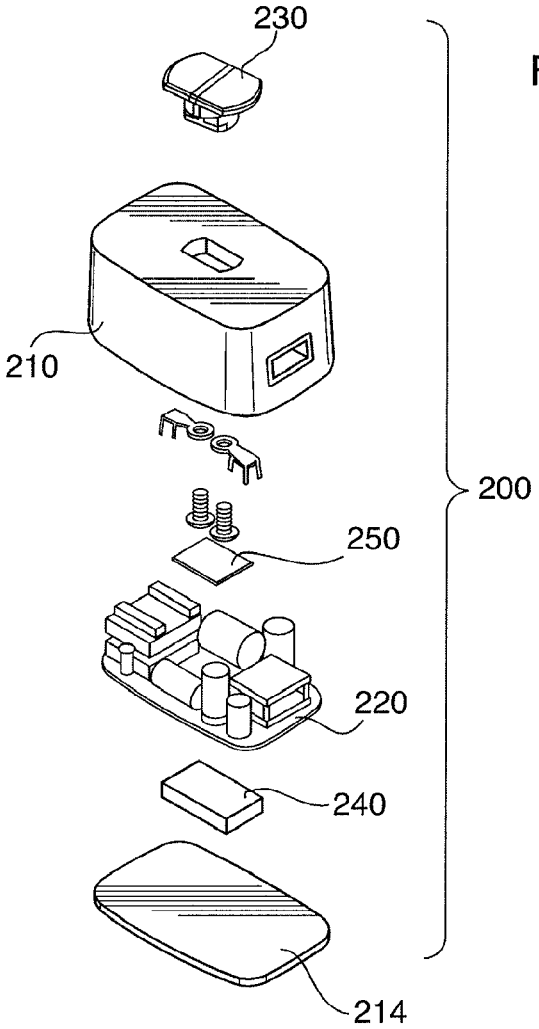
FIG. 6 is an exploded view of the base unit illustrated in FIG. 4.
Figure 7:
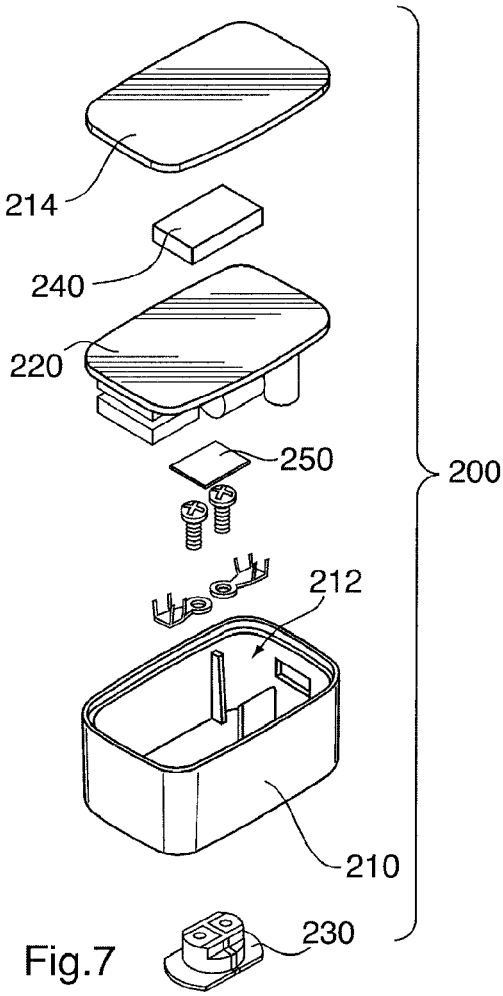
FIG. 7 is another exploded view of the base unit illustrated in FIG. 4.

In some embodiments, and referring to FIG. 5, the electrical connector plug 260 includes two contacts 262, 264 separated by an insulator 266. In some embodiments, each one of the two contacts 262, 264 is of a conductive material, such as sintered Al—Ni alloy with nickel plating, and the insulator 266 is of a non-conducive material, such as a thermo-set plastic. In some embodiments, such an electrical plug connector 260 is manufactured by providing the two metallic contacts 262, 264 and then effecting insertion molding to interpose the insulator 266 between the two metallic contacts 262, 264. In some embodiments, and referring to FIG. 5, the provided electrical plug connector 260 is substantially symmetrical about the axis X1.

In some embodiments, after the electrical connector plug 260 is inserted within the electrical connector plug receiving receptacle 420 and while the electrical connector plug 260 is disposed within the electrical connector plug receiving receptacle 420, each one of the electrical connector plug contacts 262, 264 is disposable to an electrical contact engagement state with a respective one of the adaptor unit contacts 406, 408 upon rotation of the base unit 200 relative to the adaptor unit 400 such that, when the adaptor unit 400 becomes electrically coupled to a power supply and the base unit 200 becomes disposed in an electrical coupling relationship with an electronic device and each one of the electrical connector plug contacts 262, 264 becomes disposed in electrical contact engagement with a respective one of the adaptor unit contacts 406, 408, power is supplied to the electronic device. When disposed in the above-described contact engagement condition, an electrically coupled state is provided (see, for example, FIG. 16 or 17), wherein the base unit 200 is electrically coupled to the adaptor unit 400. An electrically uncoupled state (see, for example, FIG. 15), is provided when each one of the electrical connector plug contacts 262, 264 is disposed in a spaced apart relationship relative to a respective one of the adaptor unit contacts 406, 408. In this respect, effecting a change in state from an electrically uncoupled state to an electrically coupled state includes effecting rotation of the base unit 200 relative to the adaptor unit 400.

In some embodiments, for example, the electrical connector plug receiving receptacle 420 is provided in an exterior surface of the adaptor unit 400. As described above, the electrical connector plug 260 is insertable within the electrical connector plug receiving receptacle 420, such that an inserted state between the base unit 200 and the adaptor unit 400 is effected when the electrical connector plug 260 is received within the electrical connector plug receiving receptacle 420. An operative receiving action is defined as the action of the electrical connector plug 260 being received within the electrical connector plug receiving receptacle 420. The base unit 200 is configured for disposition in any one of at least two orientations relative to the adaptor unit 400 while the operative receiving action is being effected. When in the inserted state, the electrical connector plug 260 is disposable in an electrical contact engagement state with the adaptor unit 400 in response to movement of a respective one of the at least one electrical connector plug 260 relative to the adaptor unit 400. For example, the relative movement is a rotational movement.

Figure 4:
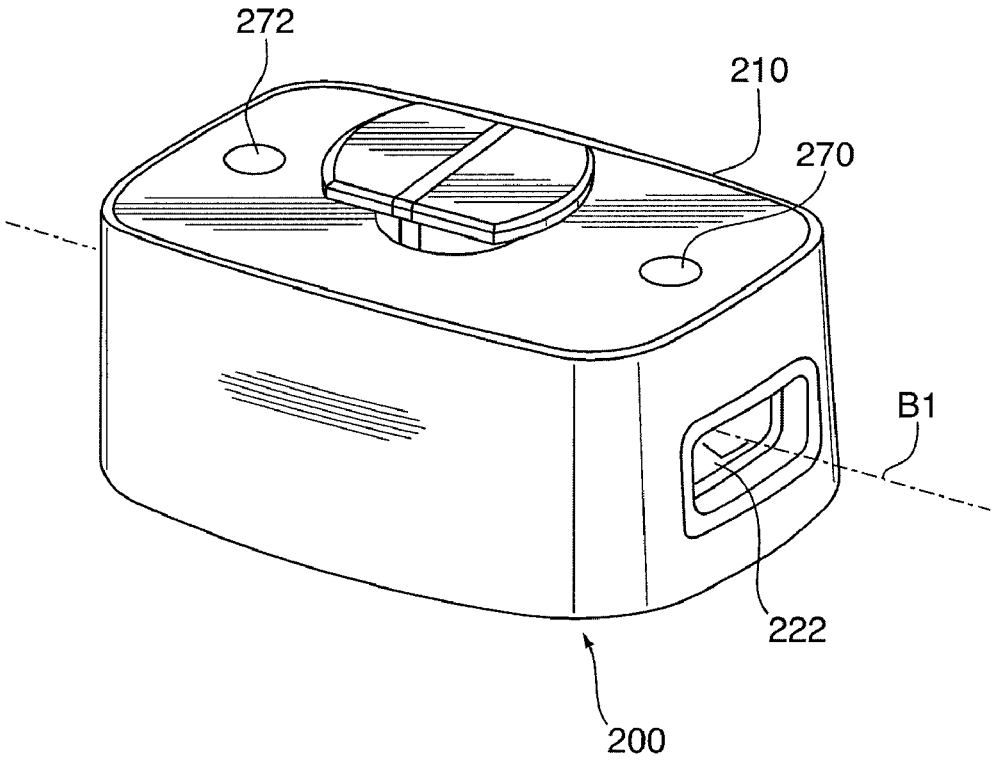
FIG. 4 is a perspective view of a base unit of the embodiment illustrated in FIG. 1.

Referring to FIG. 4, in some embodiments, the base unit 200 is providable in a first orientation relative to the adaptor unit 400 while the operative receiving action is being effected, and the base unit is also providable in a second orientation relative to the adaptor unit 400 while the operative receiving action is being effected, wherein the base unit 200 includes an axis B1, and wherein, in the first orientation of the base unit 200, the axis B1 is rotated clockwise or counter clockwise at least 45 degrees relative to its position when the base unit 200 is disposed in the second orientation. For example, in the first orientation of the base unit 200, the axis B1 is rotated clockwise 90 degrees, or about 90 degrees, relative to its position when the base unit 200 is disposed in the second orientation.

In some embodiments, and referring to FIGS. 13 and 15, an inserted uncoupled state is provided between the base unit 200 and the adaptor unit 400 when the electrical connector plug 260 is disposed within the electrical connector plug receiving receptacle 420 and the relative disposition between the electrical connector plug 260 and the adaptor unit 400 does not interfere with removal of the electrical connector plug 260 from the electrical connector plug receiving receptacle 420. When in the inserted uncoupled state, the base unit 200 and the adaptor unit 400 are mechanically and electrically uncoupled. While the base unit 200 is disposed in the inserted uncoupled state relative to the adaptor unit 400, the base unit is rotatable relative to the adaptor unit 400 so as to become disposed in an interference relationship with the adaptor unit 400 such that mechanical coupling of the base unit 200 and the adaptor unit 400 is thereby effected to provide a mechanically coupled/electrically uncoupled state between the base unit 200 and the adaptor unit 400 (see FIGS. 14 and 16). In this respect, the electrical connector plug receiving receptacle 420 includes a radially extending cavity 422 which extends radially outwardly from the electrical connector plug receiving receptacle and relative to the periphery of the electrical connector plug receiving receptacle 420. The cavity 422 is configured to receive the electrical connector plug 260 disposed within the electrical connector plug receiving receptacle as the electrical connector plug 260 is rotated with the base unit 200 relative to the adaptor unit 400 to effect a change in condition from the inserted uncoupled state to the mechanically coupled/electrically uncoupled state. The base unit 200 is disposed in an interference relationship with the adaptor unit 400 while the electrical connector plug 260 is disposed within the cavity 422. For example, the cavity 422 is provided within the housing 402 of the adaptor unit 400. Upon further rotation, the electrically coupled state is provided, wherein the base unit 200 is electrically coupled and mechanically coupled to the adaptor unit 400 (see FIG. 17). In this respect, in the electrically coupled state, each one of the electrical connector plug contacts 262, 264 of the electrical connector plug 260 is disposed in electrical contact engagement with a respective one of the adaptor unit contacts 406, 408. For example, when a change in condition from the inserted uncoupled state to the mechanically coupled/electrically uncoupled state is effected by rotation of the base unit 200 relative to the adaptor unit 400, upon further rotation of the base unit 200 relative to the adaptor unit 400, the electrical connector plug contacts 262, 264 of the electrical connector plug 260 becomes disposed in electrical contact engagement with a respective one of the adaptor unit contacts 406, 408. For example, in some embodiments, each one of the adaptor unit contacts 406, 408 is resilient, and each one of the electrical connector plug contacts 262, 264 of the electrical connector plug 260 is disposable so as to effect application of a force against a respective one of the adaptor unit contacts 406, 408 and thereby urge the respective one of the adaptor unit contacts 406, 408 into a disposition wherein the respective one of the adaptor unit contacts 406, 408 is biased towards electrical contact engagement with the electrical connector plug contact 262, 264 which has effected the urging. Likewise, electrical uncoupling of the base unit 200 from the adaptor unit 400 can be effected by rotation of the base unit 200 relative to the adaptor unit 400, and further rotation effects mechanical uncoupling, and then disposition of the base unit 200 relative to the adaptor unit 400 in the inserted uncoupled state.

In some embodiments, after the electrically coupled state is provided, upon further rotation of the base unit 200 relative to the adaptor unit 400, a locked state is effected (see FIGS. 1, 2, and 17). Likewise, a change in condition from the locked state to the unlocked state is effected by rotation of the base unit 200 relative to the adaptor unit 400, and further rotation effects the following order of events: electrical uncoupling, mechanical uncoupling, and disposition of the base unit 200 relative to the adaptor unit 400 in the inserted uncoupled state. In this respect, there is also provided a feature relating to the locking of the base unit 200 to the adaptor unit 400.

In this respect, and referring to FIGS. 9 to 14, and 20, there is provided a charger assembly 500 and a locking assembly 600. The charger assembly 500 includes the base unit 200 and the adaptor unit 400.

The locking assembly 600 includes at least one operative detent member 602, 604 configured for becoming biased into an interference relationship with the charger assembly 500 such that the at least one operative detent member 602, 604 effects resistance to relative rotation between the base unit 200 and the adaptor unit 400 when the base unit 200 is electrically coupled to the adaptor unit 400 such that a locked state (see FIGS. 1 and 2) is thereby provided. In an unlocked state (see FIGS. 13 and 14), the resistance effected by the interference relationship between the at least one operative detent member 602, 604 and the charger assembly 500 is not provided or is removed.

A change in condition from one of the locked state and the unlocked state to the other one of the locked state and the unlocked state is effected by application of a respective predetermined minimum force. For example, the respective predetermined minimum force is a torsional force.

In the unlocked state, the locking assembly 600 co-operates with the charger assembly 500 such that the base unit 200 is rotatable relative to the adaptor unit 400. After the change in state from the locked state to the unlocked state, the locking assembly 600 is disposed in co-operation with the charger assembly 500 such that the base unit 200 is rotatable relative to the adaptor unit 400 to effect electrical uncoupling of the base unit 200 from the adaptor unit 400 (for example, in some embodiments, by disengagement of the electrical connector plug contacts 262, 264 from a respective one of the adaptor unit contacts 406, 408).

In some embodiments, the relative rotation between the base unit 200 and the adaptor unit 400, which is resisted by the interference relationship between the at least one operative detent member 602, 604 and the charger assembly 500, effects uncoupling of the electrical coupling relationship between the base unit 200 and the adaptor unit 400, such that the interference relationship between the at least one operative detent member 602, 604 and the charger assembly 500 also effects resistance to electrical uncoupling of the base unit 200 from the adaptor unit 400.

In some embodiments, and as above-described, the base unit 200 and the adaptor unit 400 are configured to co-operate such that, when the base unit 200 is electrically coupled to the adaptor unit 400, a mechanically coupled state is provided wherein the base unit 200 is mechanically coupled to the adaptor unit 400, and mechanical uncoupling of the base unit 200 from the adaptor unit 400 is effected by relative rotation between the base unit 200 and the adaptor unit 400, and the biasing of the at least one operative detent member 602, 604 into an interference relationship with the charger assembly 500, such that resistance is effected to the relative rotation between the base unit 200 and the adaptor unit 400 which effects the uncoupling of the electrical coupling relationship between the base unit 200 and the adaptor unit 400, also effects resistance to the relative rotation between the base unit 200 and the adaptor unit 400 which effects the mechanical uncoupling of the base unit 200 from the adaptor unit 400.

In some embodiments, the base unit 200 and the adaptor unit 400 are co-operatively shaped such that, when the base unit 200 is electrically coupled to the adaptor unit 400, the base unit 200 and the adaptor unit 400 are mechanically coupled and disposed in an interference relationship which effects resistance to mechanical uncoupling of the base unit 200 from the adaptor unit 400, and that, after unlocking of the base unit 200 from the adaptor unit 400, the base unit 200 is rotatable relative to the adaptor unit 400 so as to provide a relative disposition between the base unit 200 and the adaptor unit 400 which does not interfere with the mechanical uncoupling of the base unit 200 from the adaptor unit 400.

In some embodiments, the locking assembly further includes at least one operative biasing member 606. Each one of the at least one operative detent member 602, 604 is coupled to and configured to co-operate with a respective at least one operative biasing member 606, 608 to effect the biasing of the respective at least one operative biasing member 606, 608. For example, each one of the at least one operative biasing member 606, 608 is a resilient member, such as a spring.

In some embodiments, for each one of the at least one detent member 602, 604, the interference relationship with the charger assembly 500 is effected by biasing the operative detent member 602, 604 with a respective at least one operative biasing member 606, 608 into disposition within a one of the respective at least one recess 270, 272 provided within one of the base unit 200 and the adaptor unit 400.

In some embodiments, the locking assembly 600 is mounted to the adaptor unit 400. For example, the locking assembly 600 is mounted within the housing 402 of the adaptor unit. In this respect, the housing 402 includes receptacles 430, 432 configured to facilitate extension or protrusion of each one of the at least one detent member 602, 604 and thereby facilitate the biasing and desired self-centering of each one of the at least one detent member 602, 604 into an interference relationship with the base unit 200.

In some embodiments, the at least one detent member is included on an electrical contact of the electrical connector plug 200.

In some embodiments, the base unit 200 includes at least one operative recess 270, 272, wherein each one of the at least one detent member 602, 604 is configured to be received in a one of the at least one operative recess 270, 272 when there is provided the locked state. For example, the base unit 200 includes a housing 210, and each one of the at least one operative recess 270, 272 is provided on the exterior surface of the housing. Each one of the at least one operative recess 270, 272 is configured to co-operate with each one of the at least one detent 602, 604 such that the locked state effected when the base unit 200 is disposed in an electrical coupling relationship with the adaptor unit 400.

In some embodiments, a mounting plate 404 is provided within the housing 402 of the adaptor unit 400. The mounting plate 404 facilitates desired alignment of each one of the at least one detent member 602, 604 with the receptacles 430, 432. In some embodiments, each one of the at least one operative detent member 602, 604 is coupled to one end of a respective one of the at least one biasing member 606, 608. The other end of each one of the at least one biasing member is mounted to a respective one of the mounting posts 440, 442 provided within the housing 402 of the adaptor unit 400.

B. Feature Relating to Mechanical Coupling of the Base Unit to the Adaptor Unit

In some embodiments, there is provided a feature relating to mechanical coupling of the base unit 200 to the adaptor unit 400 by rotation.

In this respect, there is provided the base unit 200 and the adaptor unit 400. The base unit 200 is configured for being electrically coupled to an electronic device. The adaptor unit 400 is configured for being electrically coupled to a power supply. The base unit 200 and the adaptor unit 400 are co-operatively configured to effect electrical coupling therebetween.

Referring to FIGS. 1 and 2, a mechanically coupled state is provided wherein the base unit 200 is mechanically coupled to the adaptor unit 400, and mechanical uncoupling of the base unit 200 from the adaptor unit 400 is effected by relative rotation between the base unit 200 and the adaptor unit 400.

Referring to FIGS. 4 and 20, the base unit 200 and the adaptor unit 400 are co-operatively shaped so as to become disposed in an interference relationship which effects a mechanically coupled state between the base unit 200 and the adaptor unit 400. When the mechanically coupled state is provided, rotation of the base unit 200 relative to the adaptor unit 400 effects a relative disposition between the base unit 200 and the adaptor unit 400 which does not interfere with the mechanical uncoupling of the base unit 200 from the adaptor unit 400.

In some embodiments, and referring to FIGS. 4, 8, 9, 10, 11, 12 and 20, the base unit 200 includes an electrical connector plug 260. The electrical connector plug 260 includes a plurality of electrical connector plug contacts 262, 264. The adaptor unit 400 includes a plurality of adaptor unit contacts 406, 408. The adaptor unit 400 also includes a receiving aperture 421. The receiving aperture 421 is provided on an exterior surface 425 of the adaptor unit 400 and defines an opening for an electrical connector plug receiving receptacle 420. The electrical connector plug receiving receptacle 420 extends from the receiving aperture 421 and is configured for receiving insertion of the electrical connector plug 260. In some embodiments, the electrical connector plug receiving receptacle 420 includes a continuous sidewall 4201 extending from the aperture 421 for guiding the insertion of the electrical connector plug 260 into the electrical connector plug receiving aperture 421. Any plane tangent to the continuous sidewall 4201 includes a normal axis which is transverse to the axis of the aperture 421.

In some embodiments, for example, the electrical connector plug receiving receptacle 420 is provided in an exterior surface of the adaptor unit 400. As described above, the electrical connector plug 260 is insertable within the electrical connector plug receiving receptacle 420, such that an inserted state between the base unit 200 and the adaptor unit 400 is effected when the electrical connector plug 260 is received within the electrical connector plug receiving receptacle 420. An operative receiving action is defined as the action of the electrical connector plug 260 being received within the electrical connector plug receiving receptacle 420. The base unit 200 is configured for disposition in any one of at least two orientations relative to the adaptor unit 400 while the operative receiving action is being effected. When in the inserted state, the electrical connector plug 260 is disposable in an electrical contact engagement state with the adaptor unit 400 in response to rotational movement of a respective one of the at least one electrical connector plug 260 relative to the adaptor unit 400.

Referring to FIG. 4, in some embodiments, the base unit 200 is configured for disposition in a first orientation relative to the adaptor unit 400 while the operative receiving action is being effected, and the base unit is also configured for disposition in a second orientation relative to the adaptor unit 400 while the operative receiving action is being effected, wherein the base unit 200 includes an axis B1, and wherein, in the first orientation of the base unit 200, the axis B1 is rotated clockwise or counter clockwise at least 45 degrees relative to its position when the base unit 200 is disposed in the second orientation. For example, in the first orientation of the base unit 200, the axis B1 is rotated clockwise 90 degrees, or about 90 degrees, relative to its position when the base unit 200 is disposed in the second orientation.

In some embodiments, and referring to FIG. 5, the electrical connector plug 260 includes two contacts 262, 264 separated by an insulator 266. In some embodiments, each one of the two contacts 262, 264 is of a conducive material, such as sintered Al—Ni alloy with Nickel plating, and the insulator 266 is of a non-conducive material, such as a thermo-set plastic. In some embodiments, such an electrical plug connector 260 is manufactured by providing the two metallic contacts 262, 264 and then effecting insertion molding to interpose the insulator 266 between the two metallic contacts 262, 264. In some embodiments, and referring to FIG. 5, the provided electrical plug connector 260 is substantially symmetrical about the axis X1.

In some embodiments, and referring to FIGS. 13 and 15, an inserted uncoupled state is provided between the base unit 200 and the adaptor unit 400 when the electrical connector plug 260 is disposed within the electrical connector plug receiving receptacle 420 and the relative disposition between the electrical connector plug 260 and the adaptor unit 400 does not interfere with removal of the electrical connector plug 260 from the electrical connector plug receiving receptacle 420. While the base unit 200 is disposed in the inserted uncoupled state relative to the adaptor unit 400, the base unit 200 is rotatable relative to the adaptor unit 400 so as to become disposed in an interference relationship with the adaptor unit 400 such that mechanical coupling of the base unit 200 and the adaptor unit 400 is thereby effected to provide a mechanically coupled state between the base unit 200 and the adaptor unit 400 (see FIGS. 14 and 16). In this respect, the electrical connector plug receiving receptacle 420 includes a radially extending cavity 422 which extends radially outwardly from the electrical connector plug receiving receptacle and relative to the periphery of the electrical connector plug receiving receptacle 420. The cavity 422 is configured to receive the electrical connector plug 260 disposed within the electrical connector plug receiving receptacle as the electrical connector plug 260 is rotated with the base unit 200 relative to the adaptor unit 400 to effect a change in condition from the inserted uncoupled state to the mechanically coupled state. The base unit 200 is disposed in an interference relationship with the adaptor unit 400 when the electrical connector plug 260 is received within the cavity 422. For example, the cavity 422 is provided within the housing 402 of the adaptor unit 400. Likewise, mechanical uncoupling of the base unit 200 from the adaptor unit 400 can be effected by rotation of the base unit 200 relative to the adaptor unit 400 so as to effect disposition of the base unit 200 relative to the adaptor unit 400 in the inserted uncoupled state.

In some embodiments, the mechanically coupled state is a mechanically coupled/electrically uncoupled state. When a mechanically coupled/electrically uncoupled state is provided between the base unit 200 and the adaptor unit 400, upon further rotation of the base unit 200 relative to the adaptor unit 400, the electrically coupled state is provided, wherein the base unit 200 is electrically coupled and mechanically coupled to the adaptor unit 400 (see FIG. 17). In the electrically coupled state, each one of the electrical connector plug contacts 262, 264 of the electrical connector plug 260 is disposed in electrical contact engagement with a respective one of the adaptor unit contacts 406, 408. For example, when a change in condition from the inserted uncoupled state to the mechanically coupled/electrically uncoupled state is effected by rotation of the base unit 200 relative to the adaptor unit 400, upon further rotation of the base unit 200 relative to the adaptor unit 400, the electrical connector plug contacts 262, 264 of the electrical connector plug 260 becomes disposed in electrical contact engagement with a respective one of the adaptor unit contacts 406, 408. For example, in some embodiments, each one of the adaptor unit contacts 406, 408 is resilient, and each one of the electrical connector plug contacts 262, 264 of the electrical connector plug 260 is disposable so as to effect application of a force against a respective one of the adaptor unit contacts 406, 408 and thereby urge the respective one of the adaptor unit contacts 406, 408 into a disposition wherein the respective one of the adaptor unit contacts 406, 408 is biased towards electrical contact engagement with the electrical connector plug contact 262, 264 which has effected the urging. Likewise, electrical uncoupling of the base unit 200 from the adaptor unit 400 can be effected by rotation of the base unit 200 relative to the adaptor unit 400, and further rotation effects mechanical uncoupling, and then disposition of the base unit 200 relative to the adaptor unit 400 in the inserted uncoupled state.

In some embodiments, after the electrically coupled state is provided, upon further rotation of the base unit 200 relative to the adaptor unit 400, a locked state is effected (see FIGS. 1, 2, and 17). Likewise, a change in condition from the locked state to the unlocked state is effected by rotation of the base unit 200 relative to the adaptor unit 400, and further rotation effects the following order of events: electrical uncoupling, mechanical uncoupling, and disposition of the base unit 200 relative to the adaptor unit 400 in the inserted uncoupled state. In this respect, there is also provided a feature relating to the locking of the base unit 200 to the adaptor unit 400.

In this respect, and referring to FIGS. 9 to 14, and 20, there is provided a charger assembly 500 and a locking assembly 600. The charger assembly 500 includes the base unit 200 and the adaptor unit 400.

The locking assembly 600 includes at least one operative detent member 602, 604 configured for becoming biased into an interference relationship with the charger assembly 500 such that the at least one operative detent member 602, 604 effects resistance to relative rotation between the base unit 200 and the adaptor unit 400 when the base unit 200 is electrically coupled to the adaptor unit 400 such that a locked state (see FIGS. 1 and 2) is thereby provided. In an unlocked state (see FIGS. 13 and 14), the resistance effected by the interference relationship between the at least one operative detent member 602, 604 and the charger assembly 500 is not provided or is removed.

A change in condition from one of the locked state and the unlocked state to the other one of the locked state and the unlocked state is effected by application of a respective predetermined minimum force. For example, the respective predetermined minimum force is a torsional force.

In the unlocked state, the locking assembly 600 co-operates with the charger assembly 500 such that the base unit 200 is rotatable relative to the adaptor unit 400. After the change in state from the locked state to the unlocked state, the locking assembly 600 is disposed in co-operation with the charger assembly 500 such that the base unit 200 is rotatable relative to the adaptor unit 400 to effect electrical uncoupling of the base unit 200 from the adaptor unit 400 (for example, in some embodiments, by disengagement of the electrical connector plug contacts 262, 264 from a respective one of the adaptor unit contacts 406, 408).

In some embodiments, the relative rotation between the base unit 200 and the adaptor unit 400, which is resisted by the interference relationship between the at least one operative detent member 602, 604 and the charger assembly 500, effects uncoupling of the electrical coupling relationship between the base unit 200 and the adaptor unit 400, such that the interference relationship between the at least one operative detent member 602, 604 and the charger assembly 500 also effects resistance to electrical uncoupling of the base unit 200 from the adaptor unit 400.

In some embodiments, the biasing of the at least one operative detent member 602, 604 into an interference relationship with the charger assembly 500, such that resistance is effected to the relative rotation between the base unit 200 and the adaptor unit 400 which effects the uncoupling of the electrical coupling relationship between the base unit 200 and the adaptor unit 400, also effects resistance to the relative rotation between the base unit 200 and the adaptor unit 400 which effects the mechanical uncoupling of the base unit 200 from the adaptor unit 400.

In some embodiments, the base unit 200 and the adaptor unit 400 are co-operatively shaped such that, when the base unit 200 is electrically coupled to the adaptor unit 400, the base unit 200 and the adaptor unit 400 are mechanically coupled and disposed in an interference relationship which effects resistance to mechanical uncoupling of the base unit 200 from the adaptor unit 400, and that, after unlocking of the base unit 200 from the adaptor unit 400, the base unit 200 is rotatable relative to the adaptor unit 400 so as to provide a relative disposition between the base unit 200 and the adaptor unit 400 which does not interfere with the mechanical uncoupling of the base unit 200 from the adaptor unit 400.

In some embodiments, the locking assembly further includes at least one operative biasing member 606. Each one of the at least one operative detent member 602, 604 is coupled to and configured to co-operate with a respective at least one operative biasing member 606, 608 to effect the biasing of the respective at least one operative biasing member 606, 608. For example, each one of the at least one operative biasing member 606, 608 is a resilient member, such as a spring.

In some embodiments, for each one of the at least one detent member 602, 604, the interference relationship with the charger assembly 500 is effected by biasing the operative detent member 602, 604 with a respective at least one operative biasing member 606, 608 into disposition within a one of the respective at least one recess 270, 272 provided within one of the base unit 200 and the adaptor unit 400.

In some embodiments, the locking assembly 600 is mounted to the adaptor unit 400. For example, the locking assembly 600 is mounted within the housing 402 of the adaptor unit. In this respect, the housing 402 includes receptacles 430, 432 configured to facilitate extension or protrusion of each one of the at least one detent member 602, 604 and thereby facilitate the biasing and desired self-centering of each one of the at least one detent member 602, 604 into an interference relationship with the base unit 200.

In some embodiments, the at least one detent member is included on an electrical contact of the electrical connector plug 200.

In some embodiments, the base unit 200 includes at least one operative recess 270, 272, wherein each one of the at least one detent member 602, 604 is configured to be received in a one of the at least one operative recess 270, 272 when there is provided the locked state. For example, the base unit 200 includes a housing 210, and each one of the at least one operative recess 270, 272 is provided on the exterior surface of the housing. Each one of the at least one operative recess 270, 272 is configured to co-operate with each one of the at least one detent 602, 604 such that the locked state effected when the base unit 200 is disposed in an electrical coupling relationship with the adaptor unit 400.

In some embodiments, a mounting plate 404 is provided within the housing 402 of the adaptor unit 400. The mounting plate 404 facilitates desired alignment of each one of the at least one detent member 602, 604 with the receptacles 430, 432. In some embodiments, each one of the at least one operative detent member 602, 604 is coupled to one end of a respective one of the at least one biasing member 606, 608. The other end of each one of the at least one biasing member is mounted to a respective one of the mounting posts 440, 442 provided within the housing 402 of the adaptor unit 400.

In the above description, for purposes of explanation, numerous details are set forth in order to provide a thorough understanding of the present disclosure. However, it will be apparent to one skilled in the art that these specific details are not required in order to practice the present disclosure. In other instances, well-known electrical structures and circuits are shown in block diagram form in order not to obscure the present disclosure. Although certain materials are described for implementing the disclosed example embodiments, other materials may be used within the scope of this disclosure. All such modifications and variations, including all suitable current and future changes in technology, are believed to be within the sphere and scope of the present disclosure. All references mentioned are hereby incorporated by reference in their entirety.

We claim:

1. An electrical charger comprising:

a base unit configured for being coupled to an electronic device; and an adaptor unit configured for being coupled to a power supply;

wherein the base unit includes an electrical connector plug that includes a plurality of electrical connector plug contacts;

and wherein the adaptor unit includes a plurality of adaptor unit contacts and an electrical connector plug receiving receptacle configured for receiving the electrical connector plug;

and wherein, after the electrical connector plug is removably received within the electrical connector plug receiving receptacle and while the electrical connector plug is disposed within the electrical connector plug receiving receptacle, upon rotation of the base unit relative to the adaptor unit, each one of the electrical connector plug contacts becomes disposed in a mechanical coupling state with the adaptor unit and blocked from axial separation, and also becomes disposed in an electrical coupling state with a respective one of the adaptor unit contacts such that, when the adaptor unit becomes disposed in electrical communication with a power supply and the base unit becomes disposed in an electrical coupling relationship with an electronic device and each one of the electrical connector plug contacts becomes disposed in electrical contact engagement with a respective one of the adaptor unit contacts, power is supplied to the electronic device.

2. The electrical charger as claimed in claim 1;

wherein the base unit is configured to co-operate with the adaptor unit such that the base unit is mechanically coupled to the adaptor unit when the adaptor unit is electrically coupled to the base unit.

3. The electrical charger as claimed in claim 1:

wherein the mechanical coupling state between the electrical connector plug contacts and the adaptor unit is effected by disposition of the electrical connector plug contacts relative to a detent surface of the adaptor unit such that the detent surface interferes with movement of the electrical connector plug along an axis that is parallel to an axis along which the electrical connector plug has been moved while being received within the electrical connector plug receiving receptacle.

4. The electrical charger as claimed in claim 3;

wherein upon the receiving of the electrical connector plug within the electrical connector plug receiving receptacle, the adaptor unit is disposed in an inserted uncoupled state relative to the base unit, and wherein the adaptor unit becomes disposed in the mechanically coupled state relative to the base unit upon rotation of the base unit relative to the adaptor unit, and wherein the adaptor unit becomes disposed in the electrically coupled state relative to the base unit upon further rotation of the base unit relative to the adaptor unit.

5. The electrical charger as claimed in claim 1;

wherein effecting mechanical uncoupling of the base unit from the adaptor unit includes effecting rotation of the base unit relative to the adaptor unit.

6. The electrical charger as claimed in claim 1, further comprising:

a charger assembly including the base unit and the adaptor unit;

a locking assembly including at least one operative detent member;

wherein there is provided a locked state wherein the base unit is disposed in an electrical coupling relationship with the adaptor unit, and rotation of the base unit relative to the adaptor unit, such that the base unit becomes disposed in an electrically uncoupled relationship with the adaptor unit, is resisted, and such that there is provided an unlocked state wherein the base unit is rotatable relative to the adaptor unit;

and wherein, in the unlocked state, the locking assembly co-operates with the charger assembly such that the base unit is rotatable relative to the adaptor unit;

and wherein application of a respective minimum predetermined force is required to effect a change in state from one of the locked state and the unlocked state to the other one of the locked state and the unlocked state.

7. The electrical charger as claimed in claim 6, wherein after the change in state from the locked state to the unlocked state, the locking assembly is disposed in co-operation with the charger assembly such that the base unit is rotatable relative to the adaptor unit to effect electrical uncoupling of the base unit from the adaptor unit.

8. The electrical charger as claimed in claim 1;

wherein the base unit includes an electrical connector plug;

and wherein the adaptor unit includes an electrical connector plug receiving receptacle configured for receiving the electrical connector plug;

wherein the electrical connector plug is insertable within the electrical connector plug receiving receptacle such that an inserted state between the base unit and the adaptor unit is effected when the electrical connector plug is received within the electrical connector plug receiving receptacle;

and wherein an operative receiving action is defined by the action of the electrical connector plug being received within the electrical connector plug receiving receptacle;

and wherein the base unit is disposed in any one of at least two orientations relative to the adaptor unit when the operative receiving action is being effected.

9. The electrical charger as claimed in claim 1;

wherein upon the receiving of the electrical connector plug within the electrical connector plug receiving receptacle, the adaptor unit is disposed in an inserted uncoupled state relative to the base unit, and wherein the adaptor unit becomes disposed in the mechanically coupled state relative to the base unit upon rotation of the base unit relative to the adaptor unit, and wherein the adaptor unit becomes disposed in the electrically coupled state relative to the base unit upon further rotation of the base unit relative to the adaptor unit.

* * * * *